US005385417A

United States Patent [19]

Wade et al.

[11] Patent Number: 5,385,417

[45] Date of Patent: Jan. 31, 1995

[54] KEY COVER FOR INDIVIDUAL KEY OF COMPUTER KEYBOARD

[76] Inventors: Lawrence E. Wade, 2920 Appleton Dr., West Valley City, Utah 84119; Michael L. Wade, 1379 E. Galaxie Dr., Sandy, Utah 84093

[21] Appl. No.: 44,705

[22] Filed: Apr. 12, 1993

[51] Int. Cl.[6] ..... B41J 5/26

[52] U.S. Cl. ..... 400/472; 400/490; 200/43.18

[58] Field of Search ..... 400/472, 490, 495, 496, 400/493.1, 493.2, 692, 693, 714, 679, 686, 687, 715–717, 719, 663, 672.1, 672.2, 676, 677; 235/145 R, 146; 200/43.16, 43.18, 43.19, 333, 334

[56] References Cited

U.S. PATENT DOCUMENTS

| | | | |
|---|---|---|---|
| 3,109,900 | 11/1963 | Hook | 200/43.19 |
| 3,170,050 | 2/1965 | Buturuga | 200/43.19 |
| 3,233,071 | 2/1966 | Buzzell | 200/333 |
| 3,527,914 | 9/1970 | Spacek | 200/43.19 |
| 4,057,794 | 11/1977 | Grossfield | 200/333 |
| 4,496,811 | 1/1985 | Irwin | 200/43.18 |
| 4,820,887 | 4/1989 | Schmitz | 200/43.18 |
| 5,150,913 | 9/1992 | Hoelzl | 200/43.18 |

FOREIGN PATENT DOCUMENTS

| | | | |
|---|---|---|---|
| 2253263 | 6/1975 | France | 200/333 |
| 0109563 | 4/1925 | Switzerland | 200/333 |

OTHER PUBLICATIONS

Nordy, "Switch Operation Protection", Aug. 1975, vol. 18, pp. 899–900 Patent Associated Literature (IBM Technical Disclosure Bulletin).

*Primary Examiner*—Edgar S. Burr
*Assistant Examiner*—Anthony H. Nguyen
*Attorney, Agent, or Firm*—Terry M. Crellin

[57] ABSTRACT

A cover is disclosed that can be easily and quickly positioned over a single key on a keyboard. The cover has pressure sensitive adhesive on its feet for securely affixing the cover to the housing of the keyboard such that the cover is maintained in place over the key on the keyboard which is to be covered. A pair of sidewalls extend upwardly from the feet of the cover. The sidewalls are spaced apart by a distance sufficient to span a single key on the keyboard. A top wall extends between the upper ends of the sidewalls. The top wall is provided with a central opening having a size such that a tip of a pencil or other similar device can be pushed through the opening to engage the key below the top cover.

1 Claim, 1 Drawing Sheet

KEY COVER FOR INDIVIDUAL KEY OF COMPUTER KEYBOARD

BACKGROUND OF THE INVENTION

1. Field of the Invention

The present invention relates to covers for keys of a keyboard such as keyboard used for input of information and data to a computer. More particularly, the present invention elates to a cover for an individual key on such a keyboard, wherein the cover prevents inadvertent actuation of the key, and further wherein the cover is provided with simple means of manually activating the key which is covered when in fact it is desired to depress the covered key.

2. State of the Art

It is well known to provide dust covers that cover essentially the entire keyboard of a typewriter or data input keyboard or station of a computer. The purpose of such covers is to protect all of the keys on the keyboard from dirt and moisture when the keyboard is not being used. Flexible covers have been used that are molded to fit the arrangement of keys on a particular keyboard such that the cover can be used when the keyboard is being used as well as when it is not. However, these covers do not prevent the inadvertent actuation of any particular key on the keyboard.

Many times when using spread sheet and/or word processing software, an operator will inadvertently depress the escape key or the break key. There is a distinct possibility of losing several hours or more of work when such an inadvertent actuation of the escape key or break key is made. Anyone who has experienced the loss of several hours of work on a computer because of inadvertently depressing the escape key or break key know the desirability of an inexpensive means for protecting against such inadvertent actuation while still providing the operator a way of quickly and easily operating the escape key or break key when it is expressly desired to operate such key.

3. Objectives

A principal objective of the present invention is to provide a novel, inexpensive cover that will cover an individual key of a keyboard.

A particular objective of the present invention is to provide such a cover that has feet that can quickly be adhered to the housing of the keyboard to securely hold the cover in place to cover the desired key on the keyboard.

An additional objective of the present invention is to provide such a cover for an individual key of a keyboard wherein the top of the cover has a small opening therein through which the tip of a pencil or similar item can be inserted to depress the otherwise covered key.

SUMMARY OF THE INVENTION

The above objectives are achieved in accordance with the present invention by providing a novel cover that can be easily and quickly positioned over a single key on a keyboard, with the cover having a pressure sensitive adhesive on its feet for securely affixing the cover to the housing of the keyboard such that the cover is maintained in place over the key on the keyboard which is to be covered.

In a preferred embodiment of the cover of the present invention, a pair of sidewalls extend upwardly from the feet of the cover. The sidewalls are positioned substantially vertical with respect to the feet, and the sidewalls are essentially parallel with each other. The sidewalls are spaced apart by a distance sufficient to span a single key on a keyboard. A top wall extends between the upper ends of the sidewalls and holds the sidewalls in their spaced, parallel configuration. The top wall is preferably provided with a central opening having a size such that a tip of a pencil or other similar device can be pushed through the opening to engage the key below the top cover. When it is desired to actuate the key that is covered by the cover of this invention, a pencil or other similar device is inserted through the opening in the top wall of the cover to manually depress the key under the top wall of the cover.

Additional objects and features of the present invention will become apparent from the following detailed description, taken together with the accompanying drawings.

THE DRAWINGS

A preferred embodiment of the present invention representing the best mode presently contemplated of carrying out the invention is illustrated in the accompanying drawings, in which.

DETAILED DESCRIPTIONS OF THE PREFERRED EMBODIMENT

Figure 1:
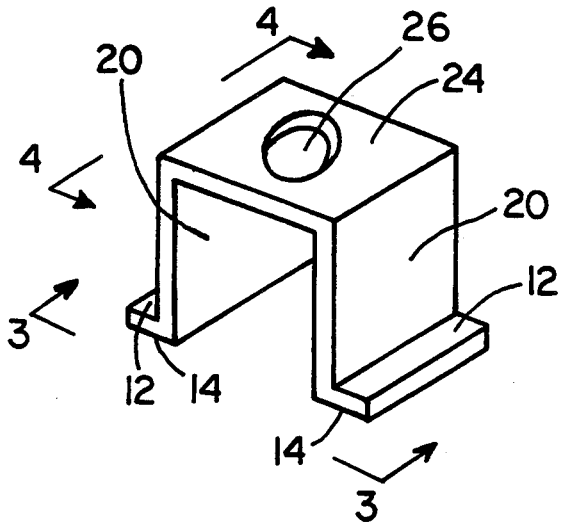
FIG. 1 is a pictorial top view of a preferred embodiment of a key cover of the present invention.
Figure 2:
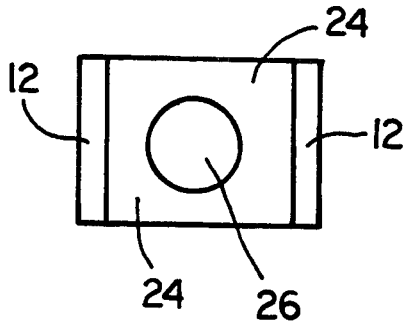
FIG. 2 is a top, plan view of the key cover of FIG. 1.

Referring now to the drawings, there is shown a preferred embodiment of a protective cover for an individual key on a computer keyboard in accordance with the present invention. The cover comprises a pair of spaced apart feet 12. In the preferred embodiment as illustrated, there are two feet 12. Each foot 12 has an elongate, flat, narrow bottom surface 14. Preferably, each bottom surface 14 has a length of between about $\frac{3}{8}$ of an inch to I inch and a width of from about 1/16 of an inch and 3/16 of an inch. The feet 12 are spaced apart sufficiently so that they can span an individual key on a computer keyboard. It should be recognized that each foot 12 of the embodiment illustrated in the drawings could be divided into two or three segments. If divided into two segments, the segments would be at the opposite ends of the foot as shown in the drawings. If divided into three segments, two segments would be at opposite ends of the foot as shown in the drawings, and the third segment would be located generally equidistant of the other two. In any situation, it is important to provide sufficient combined bottom surface areas 14 so that a pressure sensitive adhesive can be applied to the bottom surfaces 14 to firmly attach the key cover to the housing of the keyboard.

A pair of sidewalls 20 are provided for the feet 12 at each side of the cover. As illustrated in the drawings, there are two feet 12, one at each side of the cover, and there are two sidewalls 20 shown extending upwardly from the respective feet 12. If the feet 12 on each side of the cover were divided into two or three segments, the sidewalls 20 could also, if desired, be divided into an equal number of segments, with one segment extending upwardly from a respective segment of the feet. Each sidewall 20 or segment of a sidewall extends upwardly from a respective foot 12 or segment of such foot 12. Each sidewall 20, including all the segments if the sidewall is divided into segments, has a width substantially the same as the length of the bottom surfaces of each foot 12 at the side of the cover, with each foot 12 including all segments that the foot 12 may be divided into. The sidewalls 20 further preferably have a height of between about $\frac{3}{8}$ of an inch and $\frac{5}{8}$ of an inch.

A top wall 24 is connected to upper ends of the sidewalls 20 or the upper ends of the upper ends of the respective segments of each sidewall 20 if the sidewall 20 is divided into segments. The top wall 24 has a width substantially the same as the width of the sidewalls 20. If the sidewalls 20 are divided into segments, the top wall has a width substantially the same as the distance between the outer side edges of the two outside segments of the sidewall 20. An opening 26 is provided in the top wall 24. The opening 26 has a size just sufficient that the tip of a pencil or similar item can be inserted therein to depress a key over which the cover is positioned.

Figure 3:
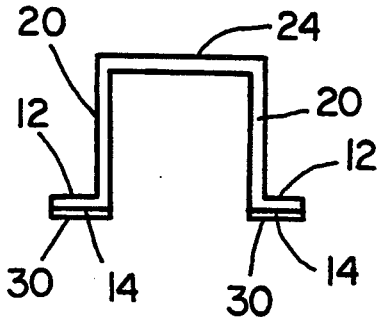
FIG. 3 is a front elevation of the key cover of FIG. 1 taken along line 3—3 of FIG. 1.
Figure 4:
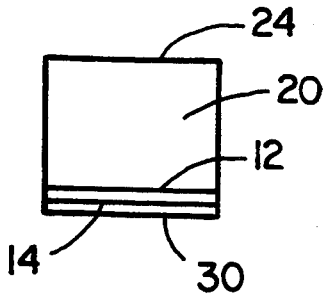
FIG. 4 is a side elevation of the key cover of FIG. 1 taken along line 4—4 of FIG. 1.

The cover fits over and covers a single, desired key of a keyboard. To mount the cover to the housing of the keyboard, a pressure sensitive adhesive is provided on the bottom surfaces 14 to adhere the bottom surfaces 14 of the feet 12 of the cover to the housing of a keyboard such that the cover spans and covers a desired key on the keyboard. Preferably, a layer of adhesive material is applied to the bottom surfaces of said feet. The layer of adhesive material can include a thin layer of foam material 30 as shown in FIGS. 3 and 4 of the drawings. The thin layer of foam material is applied to the bottom surfaces 14 of the feet 12, with a layer of pressure sensitive adhesive material applied to the exposed bottom side of the layer of foam material.

In the preferred embodiment as illustrated in the drawings, the feet 12 are not segmented and form one foot 12 on each side of the cover. In the illustrated embodiment the elongate bottom surface 14 of each foot 12 has a length of between about $\frac{1}{2}$ of an inch and $\frac{3}{4}$ of an inch and a width of about $\frac{1}{8}$ of an inch. The sidewalls of the preferred embodiment have a height of about $\frac{1}{2}$ of an inch. The opening 26 in the top wall 24 is preferably circular in shape and has a diameter of about 5/16 of an inch.

As illustrated in the drawings, the pair of feet are parallel with each other and spaced apart so as to lie on the housing of the keyboard along opposite sides of the key on the keyboard that is to be covered. It should be recognized, however, that on some keyboards the key that is desired to be covered may extend from the housing of the keyboard such that the housing is accessible on adjacent, perpendicular sides of the key rather than opposite parallel sides of the key. In such cases, the pair of feet of the cover of the present invention would be oriented perpendicular to each other so that the feet can lie on the accessible surfaces of the housing of the keyboard along the adjacent sides of the key that is to be covered. The top wall of the cover would be connected to the upper ends of the sidewalls that extend upwardly from the pair of feet. The top wall would be in a fashion cantilevered from the upper ends of the sidewalls so as to extend over and cover the top of the key that is to be covered.

It is to be understood that the present disclosure, including the detailed description of the preferred embodiment, is made by way of example and that various other embodiments are possible without departing from the subject matter coming within the scope of the following claims, which subject matter is regarded as the invention.

We claim:

1. A protective cover for an individual key on a computer keyboard, said cover comprising a pair of spaced apart feet, said feet having elongate, flat, narrow bottom surfaces, with each bottom surface having a length of between about $\frac{3}{8}$ of an inch to 1 inch and a width of from about 1/16 of an inch and 3/16 of an inch, said feet being spaced apart sufficiently so that the feet can span an individual key on a computer keyboard;

a pair of sidewalls, with each sidewall extending upwardly from a respective one of said pair of feet, said sidewalls having a width substantially the same as the length of the bottom surfaces of said feet, said sidewalls further having a height of between about $\frac{3}{8}$ of an inch and $\frac{5}{8}$ of an inch;

a top wall connected to upper ends of said pair of sidewalls, said top wall having a width substantially the same as the width of said sidewalls;

an opening in the top wall, said opening having a size just sufficient that the tip of a pencil can be inserted therein to depress a key over which the cover is positioned; and means for adhering the bottom surfaces of said feet to the housing of a computer keyboard such that the cover fits over and covers a desired key of the keyboard, wherein said means for adhering the bottom surfaces of said feet to the housing comprises a thin layer of foam material adhered to the bottom surfaces of said feet and a layer of adhesive material applied to the exposed bottom side of said layer of foam material.

* * * * *